US012084933B2

(12) United States Patent
Jin et al.

(10) Patent No.: US 12,084,933 B2
(45) Date of Patent: Sep. 10, 2024

(54) MULTI-POINT DRILLING AND SAMPLING DEVICE APPLIED TO SEAFLOOR TRACKED VEHICLE

(71) Applicant: HUNAN UNIVERSITY OF SCIENCE AND TECHNOLOGY, Xiangtan (CN)

(72) Inventors: Yongping Jin, Xiangtan (CN); Zhaodong Tong, Xiangtan (CN); Youduo Peng, Xiangtan (CN)

(73) Assignee: HUNAN UNIVERSITY OF SCIENCE AND TECHNOLOGY, Xiangtan (CN)

( * ) Notice: Subject to any disclaimer, the term of this patent is extended or adjusted under 35 U.S.C. 154(b) by 0 days.

(21) Appl. No.: 18/457,150

(22) Filed: Aug. 28, 2023

(65) Prior Publication Data

US 2023/0399910 A1 Dec. 14, 2023

(30) Foreign Application Priority Data

Feb. 22, 2023 (CN) ..... 202310148948.0

(51) Int. Cl.
*E21B 25/18* (2006.01)
*B63G 8/00* (2006.01)

(52) U.S. Cl.
CPC ..... *E21B 25/18* (2013.01); *B63G 8/001* (2013.01)

(58) Field of Classification Search
CPC ..... E21B 25/18; B63G 8/001
USPC ..... 175/6
See application file for complete search history.

(56) References Cited

U.S. PATENT DOCUMENTS

| | | | | |
|---|---|---|---|---|
| 3,714,996 | A * | 2/1973 | Dane | E21B 25/18 175/6 |
| 4,043,407 | A * | 8/1977 | Wilkins | E21B 7/124 175/6 |
| 4,444,275 | A * | 4/1984 | Beynet | E21B 41/10 166/341 |
| 2002/0134552 | A1 * | 9/2002 | Moss | E21B 23/12 166/70 |
| 2009/0178848 | A1 * | 7/2009 | Nellessen, Jr. | E21B 19/086 175/7 |
| 2013/0206476 | A1 * | 8/2013 | Innes | E21B 41/04 175/6 |

FOREIGN PATENT DOCUMENTS

| | | |
|---|---|---|
| CN | 211777297 U | 10/2020 |
| CN | 115370290 A | 11/2022 |

* cited by examiner

*Primary Examiner* — Tara Schimpf
*Assistant Examiner* — Patrick F Lambe

(57) ABSTRACT

A drilling and sampling device applied to a seafloor tracked vehicle, including a slide seat, a positioning electromagnet, a pipe-replacing cylinder, a dial claw, a plurality of clamping assemblies, a plurality of sampling drill pipes, a drill pipe rack, a frame, a thrust cylinder, a pipe-releasing assembly, a guide rod, a drive pipe, a power head, and a pipe-replacing disc. The guide rod and the thrust cylinder are fixedly arranged on the frame. The slide seat is in clearance fit with the guide rod. A piston rod end of the thrust cylinder is hingedly connected to the slide seat. The power head is fixedly arranged on the slide seat. The drive pipe is arranged at an output end of the power head, and is coaxially screwed with the plurality of sampling drill pipes. The dial claw is slidably arranged in the arc guide groove.

7 Claims, 5 Drawing Sheets

MULTI-POINT DRILLING AND SAMPLING DEVICE APPLIED TO SEAFLOOR TRACKED VEHICLE

CROSS-REFERENCE TO RELATED APPLICATIONS

This application claims the benefit of priority from Chinese Patent Application No. 202310148948.0, filed on Feb. 22, 2023. The content of the aforementioned application, including any intervening amendments thereto, is incorporated herein by reference in its entirety.

TECHNICAL FIELD

This application relates to marine machinery, and more particularly to a multi-point drilling and sampling device applied to a seafloor tracked vehicle.

BACKGROUND

Mankind has entered a new stage of developing marine resources and utilizing the ocean strategic space in the 21$^{st}$ century. Seafloor drilling rigs are important devices and thus are deserved to be focused on and studied. To explore the material composition of the seafloor, the seafloor drilling rig is lowered to the seafloor to obtain the seafloor samples by drilling. As the drilling process generally takes a long time, the drilling rig is equipped with multiple sampling drill pipes to improve the sampling efficiency and accurately obtain seafloor samples from multiple locations, and in the meanwhile, it must be connected to the sampling drill pipes successively during the precise movement, so as to realize the drilling and sampling from multiple locations. Unfortunately, at present, research on multiple-point sampling is barely in China, and most of the research is focused on single-point drilling and sampling on the seafloor. For example, Chinese Patent Application No. 201922468843.5 discloses a deep-sea electric drive drilling, clamping, and sampling device for the seafloor crust, which is equipped with one sampling drill pipe to perform the single-point sampling in the seafloor crust.

Chinese Patent Application No. 202211030422.4 discloses a deep-sea micro-sampling robot. A drill pipe frame is driven by a hydraulic cylinder drive ratchet wheel to rotate and is provided with a plurality of sampling drill pipes. The plurality of sampling drill pipes can be successively connected to the drilling device, and then the robot is driven by four traveling wheels to move, so as to realize the multi-point sampling. To clamp the sampling drill pipes, each of the sampling drill pipes is provided with a notch, which reduces the strength of the sampling drill pipes. Moreover, if the sediment blocks the notch, the sampling drill pipe is difficult to be firmly clamped on the drill pipe frame. In addition, under the harsh environment of the deep sea, the guide rail on the drilling device is prone to abrasion and wear, seriously affecting the drilling efficiency.

Therefore, it is urgent to develop a multi-point drilling and sampling device based on a seafloor tracked vehicle, which can reliably clamp the sampling drill pipes without destroying their structural strength, reduce the abrasion and wear of the guide rail of the drilling device, and enable the sampling drill pipes to be successively connected to the drilling device accurately and reliably.

SUMMARY

To solve the above technical problems, the present disclosure provides a multi-point drilling and sampling device with simple structure and convenient operations, which can reliably clamp sampling drill pipes and realize rod replacement, and has a reliable and durable guide rail.

The technical solution of the present disclosure is described below.

This application provides a drilling and sampling device applied to a seafloor tracked vehicle, comprising:

a slide seat;
a positioning electromagnet;
a pipe-replacing cylinder;
a dial claw;
a plurality of clamping assemblies;
a plurality of sampling drill pipes;
a drill pipe rack;
a frame;
two thrust cylinders;
a pipe-releasing assembly;
a guide rod;
a drive pipe;
a power head; and
a pipe-replacing disc;

wherein the frame comprises a lower frame, a middle shaft and an upper frame from bottom to up; the upper frame is arranged on the lower frame through the middle shaft; the middle shaft is arranged perpendicular to the lower frame and the upper frame; the drill pipe rack is arranged outside the middle shaft and is coaxial with the middle shaft, and is capable of rotating around the middle shaft; the drill pipe rack is provided with a plurality of first drill pipe holes; the plurality of sampling drill pipes are provided in the plurality of first drill pipe holes in one-to-one correspondence; an axis of each of the plurality of the sampling drill pipes is parallel to an axis of the middle shaft; the plurality of sampling drill pipes are evenly arranged around a circumferential direction of the drill pipe rack; the plurality of clamping assemblies are arranged at the plurality of first drill pipe holes in one-to-one correspondence; the plurality of clamping assemblies are configured to respectively clamp the plurality of sampling drill pipes; and the pipe-replacing disc is coaxially and fixedly arranged on a top of the drill pipe rack;

the guide rod and the two thrust cylinders are fixedly arranged on the frame; axes of the guide rod and the two thrust cylinders are parallel to the axis of each of the plurality of sampling drill pipes; the slide seat is provided with a guide hole; the slide seat is in clearance fit with the guide rod; a piston rod end of one of the two thrust cylinders is hingedly connected to a first end of the slide seat, and a piston rod end of the other of the two thrust cylinders is hingedly connected to a second end of the slide seat; the power head is fixedly arranged on the slide seat; the drive pipe is arranged at an output end of the power head; the drive pipe is configured to be coaxially and screwedly connected with each of the plurality of sampling drill pipes through a second drill pipe hole on the upper frame; and the pipe-releasing assembly is arranged at a position on a bottom surface of the upper frame where the second drill pipe hole is located; the upper frame is provided with an arc guide groove coaxial with the drill pipe rack; the dial claw is slidably arranged in the arc guide groove; a lower portion of the dial claw is engaged with rectangular teeth on an edge of the pipe-replacing disc; an upper portion of the dial claw is hingedly connected to a first end of the pipe-replacing cylinder, and a second end of the pipe-replacing cylinder is hingedly connected to the upper frame; the positioning electromagnet is arranged on the upper frame; a moving end of the positioning electromagnet is configured to pass through the upper frame to be coaxially inserted into a positioning hole of the pipe-replacing disc; and a diameter of the moving end is equal to that of the positioning hole of the pipe-replacing disc.

In some embodiments, each of the plurality of clamping assemblies comprises a fixed clamping block, a gasket, a movable clamping block, a loose piece, two bolts, a pre-tensioning spring, and a pipe-clamping cylinder; the fixed clamping block is fixedly arranged on the drill pipe rack; the two bolts are provided on the fixed clamping block and parallel to each other; a first semi-circular groove is provided on an end surface of the fixed clamping block towards a center of a corresponding first drill pipe hole of the plurality of first drill pipe holes; the gasket is fixedly arranged in the first semi-circular groove; the first semi-circular groove is coaxial with the corresponding first drill pipe hole; the movable clamping block is provided with two first bolt holes parallel to each other, and is sleeved on the two bolts through the two first bolt holes; a second semi-circular groove is provided on an end surface of the movable clamping block towards the fixed clamping block; two sides of the pipe-clamping cylinder each are provided with a second bolt hole; the pipe-clamping cylinder is sleeved on the two bolts; each of the two bolts is sleevedly provided with the pre-tensioning spring; the pre-tensioning spring is located between the pipe-clamping cylinder and the movable clamping block; a piston rod of the pipe-clamping cylinder abuts against the movable clamping block; a chamber of the pipe-clamping cylinder near the movable clamping block is communicated with outside and is capable of being filled with sea water.

In some embodiments, the number of the pipe-releasing assembly is two or more; the loose piece consists of a side plate and a bottom plate perpendicular to the side plate; the bottom plate is fixed on a top surface of the movable clamping block; the side plate is provided with a screw; an axis of the screw is perpendicular to the axis of each of the plurality of sampling drill pipes; the two or more pipe-releasing assemblies are in one-to-one correspondence to the plurality of clamping assemblies; each of the two or more pipe-releasing assemblies comprises two pipe-releasing electromagnets and a pipe-releasing plate; the two pipe-releasing electromagnets are respectively fixed on two sides of the second drill pipe hole on the bottom surface of the upper frame; two ends of the pipe-releasing plate are fixed to movable ends of the two pipe-releasing electromagnets, respectively; and the pipe-releasing plate is in contact with an end of the screw away from the pipe-clamping cylinder.

In some embodiments, the drill pipe rack comprises a lower disc, a lower sleeve, an upper disc, an upper sleeve, and a bushing; the lower disc is coaxial with the upper disc; a plurality of first through holes are uniformly provided on the lower disc around a circumferential direction of the lower disc, and a plurality of second through holes are uniformly provided on the upper disc around a circumferential direction of the upper disc; the plurality of first through holes are in one-to-one correspondence with the plurality of second through holes; and one of the plurality of first through holes and one of the plurality of second through holes corresponding thereto are coaxial to form one of the plurality of first drill pipe holes; and the bushing is fixedly arranged in each of the plurality of first through holes, and an inner diameter of the bushing is larger than an outer diameter of each of the plurality sampling drill pipes; the upper sleeve is weldedly arranged in a center hole of the upper disc, and the lower sleeve is weldedly arranged in a center hole of the lower disc; the upper sleeve is sleeved in an inner hole of the lower sleeve, and is fixedly connected to the lower sleeve; and an upper ribbed plate is weldedly connected to a lower end surface of the upper disc, and a lower ribbed plate is weldedly arranged between the lower sleeve and an upper end surface of the lower disc.

In some embodiments, the lower frame comprises two side plates, a reinforcement plate, a main plate and a lower shaft; an end of the lower shaft is perpendicularly fixed to the main plate; a through inner hole is provided on the lower frame at an axis of the lower shaft; the two side plates are perpendicularly welded on two sides below the main plate, respectively; a lower part of each of the two side plates is provided with a rack mounting hole at a position near the axis of the lower shaft; the reinforcement plate is perpendicularly welded between the two side plates, and is welded to a bottom of the main plate; a first sliding bearing is provided between the drill pipe rack and the lower frame; and a lower portion of the first sliding bearing is located between a lower end surface of the drill pipe rack and the main plate, and an upper portion of the first sliding bearing is located between the lower shaft and an inner hole of the drill pipe rack.

In some embodiments, a lower end surface of the middle shaft is coaxially welded to an upper end surface of the lower shaft; a second sliding bearing is provided between the middle shaft and the drill pipe rack; a lower portion of the second sliding bearing is located between the middle shaft and the drill pipe rack, and an upper portion of the second sliding bearing is located between a positioning ring on the middle shaft and the lower sleeve of the drill pipe rack; and an upper end surface of the second sliding bearing is located below a lower end surface of an upper sleeve of the plurality of sampling drill pipes.

In some embodiments, the dial claw comprises a slide frame, a seesaw, a claw head, a spring sheet and an electromagnetic head; an upper portion of the slide frame is hingedly connected to an end of the pipe-replacing cylinder; a middle portion of the slide frame is mounted in the arc guide groove of the upper frame; a lower portion of the slide frame is hingedly connected to a middle portion of the seesaw, wherein a hinged axis is parallel to an axis of the arc guide groove; the electromagnetic head is fixedly provided near each of two outer ends of the seesaw; each of two ends of the seesaw is fixedly provided with the spring sheet; the spring sheet is provided with the claw head; a side of the claw head near an end of the seesaw abuts against the end of the seesaw; a side of the claw head towards a side of the pipe-replacing disc is inclined; and the electromagnetic head is capable of controlling the claw head to be clamped into a rectangular groove on the pipe-replacing disc.

Compared with the prior art, this application has the following beneficial effects.

(1) The multi-point drilling and sampling device provided herein has a simple structure and reliable functions and can independently clamp each sampling drill pipe. It has the characteristics of high positioning accuracy and reliable clamping while avoiding cutting grooves on the drill pipes, which does not affect the strength and life of the drill pipes.

(2) The clamping assembly provided herein is provided with a pre-tensioning spring such that the sampling drill pipes are not lost even in the state of hydraulic system failure, ensuring high reliability. Meanwhile, the fixed clamping block is accurately fixed with the drill pipe holder through screws, which can accurately fix the position of the sampling drill pipe, thereby realizing the efficient buckling and shackling of the sampling drill pipes.

(3) A cylindrical guide rod is provided herein, which can achieve reliable oil sealing and greatly improve the friction environment of the guide rail. At the same time, two thrust cylinders are provided, which can achieve the guiding effect under the condition that the guide rail is subjected to a subtle torque, thereby improving the force state of the guide rail. By such arrangements, the service life and guiding performance of the guide rail can be greatly improved.

(4) A pipe-replacing disc and a dial claw provided herein have a simple structure and reliable functions, which can achieve bi-directional rotation of the drilling rod and improve the efficiency of rod replacement. Moreover, the rod-replacing disc and the dial claw are wear-resistant and can be well adapted to the harsh environment of the seabed containing mud and sand.

Figure 1:
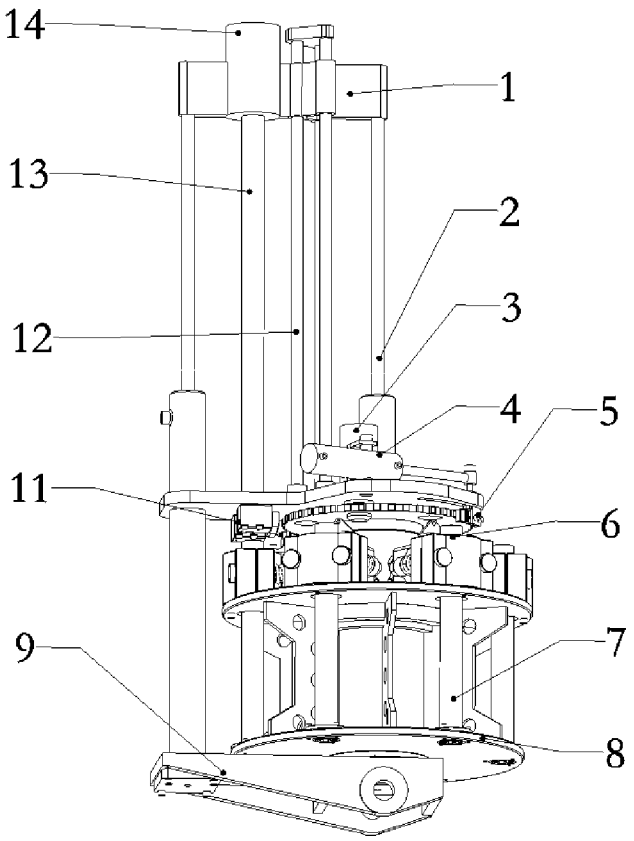
FIG. 1 is a structural diagram of a drilling and sampling device according to an embodiment of the present disclosure.
Figure 2:
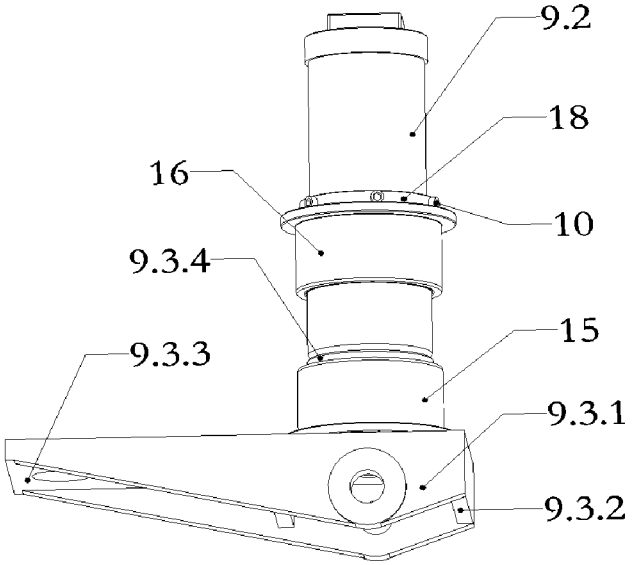
FIG. 2 is a structural diagram of a lower part of the drilling and sampling device according to an embodiment of the present disclosure.
Figure 3:
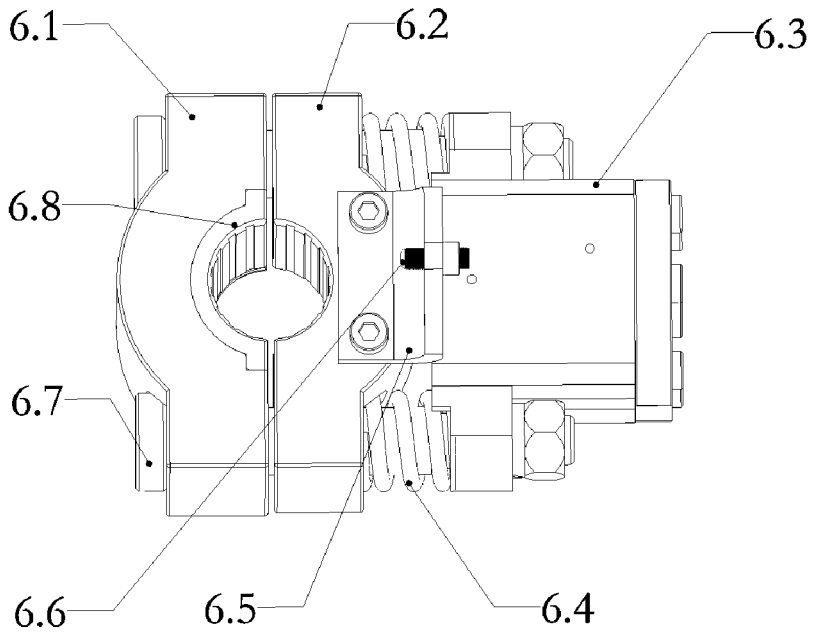
FIG. 3 is a structural diagram of a clamping assembly of the drilling and sampling device according to an embodiment of the present disclosure.
Figure 4:
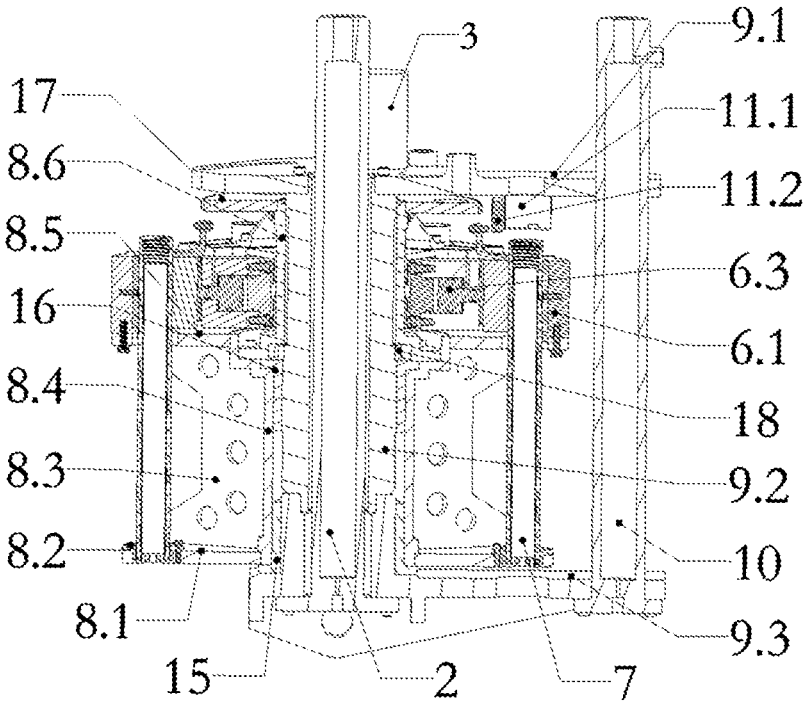
FIG. 4 is a sectional view of the lower part of the drilling and sampling device according to an embodiment of the present disclosure.

In the drawings, 1, slide seat; 2, thrust cylinder; 3, positioning electromagnet; 4, pipe-replacing cylinder; 5, dial claw; 6, clamping assembly; 7, sampling drill pipe; 8, drill pipe rack; 9, frame; 10, positioning ring screw; 11, pipe-releasing assembly; 12, guide rod; 13, drive pipe; 14, power head; 15, first sliding bearing; 16, second sliding bearing; 17, pipe-replacing disc; 18, positioning ring; 5.1, slide frame; 5.2, electromagnetic head; 5.3, seesaw; 5.4, spring sheet; 5.5 claw head; 6.1, fixed clamping block; 6.2, movable clamping block; 6.3, clamping cylinder; 6.4, pre-tensioning spring; 6.5, loose piece; 6.6, screw; 6.7, bolt; and 6.8, gasket; 8.1, lower disc; 8.2, bushing; 8.3, ribbed plate; 8.4, lower sleeve; 8.5, upper disc; and 8.6, upper sleeve; 9.1 upper frame; 9.2, middle shaft; and 9.3 lower frame; 9.3.1, side plate; 9.3.2, reinforcement plate; 9.3.3, main plate; and 9.3.4, lower shaft; 11.1, pipe-releasing electromagnet; and 11.2, pipe-releasing plate.

DETAILED DESCRIPTION OF EMBODIMENTS

The present disclosure is further described below with reference to the accompanying drawings.

As shown in FIGS. 1-4, a drilling and sampling device is provided, which includes a slide seat 1, a thrust cylinder 2, a positioning electromagnet 3, a pipe-replacing cylinder 4, a dial claw 5, a clamping assembly 6, a sampling drill pipe 7, a drill pipe rack 8, a frame 9, a positioning ring screw 10, a pipe-releasing assembly 11, a guide rod 12, a drive pipe 13, a power head 14, a pipe-replacing disc 17, and a positioning ring 18.

The frame includes an upper frame 9.1, a middle shaft 9.2 and a lower frame 9.3. The upper frame 9.1 is arranged on the lower frame 9.3 through the middle shaft 9.2. The middle shaft 9.2 is arranged perpendicular to the lower frame 9.3 and the upper frame 9.1. An upper end of the middle shaft 9.2 runs through the upper frame 9.1, and a lower end of the middle shaft 9.2 is coaxially connected to a lower shaft 9.3.4 of the lower frame 9.3. The lower frame 9.3 is provided with two mounting holes for fixing the drilling and sampling device to a tracked vehicle frame. Two thrust cylinders 2 are fixedly arranged on the lower frame 9.3, and a guide rod 12 is arranged on the upper frame 9.1. An upper end of one of the two thrust cylinders 2 passes through the upper frame 9.1 to be hingedly connected to a first end of the slide seat 1, and an upper end of the other of the two thrust cylinders 2 passes through the upper frame 9.1 to be hingedly connected to a second end of the slide seat 1. The slide seat 1 is sleevedly arranged on the guide rod 12 to be in clearance fit with the guide rod 12. The two thrust cylinders 2 can achieve the smooth rise and fall of the slide seat 1 through synchronous expansion and contraction. The guide rod 12 ensures the movement precision of the slide seat 1. A power head 14 is arranged on the middle of the slide seat 1, and the drive pipe 13 is arranged at an output end of the power head 14.

The drill pipe rack 8 is arranged outside the middle shaft 9.2 and is coaxial with the middle shaft 9.2, and is capable of rotating around the middle shaft 9.2. The drill pipe rack 8 includes a lower disc 8.1, a bushing 8.2, a lower sleeve 8.4, an upper disc 8.5, and an upper sleeve 8.6. The lower disc 8.1 is coaxial with the upper disc 8.5. A plurality of first through holes are uniformly provided on the lower disc 8.1 around a circumferential direction of the lower disc 8.1, and a plurality of second through holes are uniformly provided on the upper disc 8.5 around a circumferential direction of the upper disc 8.5. The plurality of first through holes are in one-to-one correspondence with the plurality of second through holes. One of the plurality of first through holes and one of the plurality of second through holes corresponding thereto are coaxial to form a drill pipe hole. The bushing 8.2 is fixedly arranged in each of the plurality of first through holes, and an inner diameter of the bushing 8.2 is larger than an outer diameter of the sampling drill pipe. The lower sleeve 8.4 is weldedly arranged in a center hole of the lower disc 8.1, and the upper sleeve 8.6 is weldedly arranged in the center hole of the upper disc. The upper sleeve 8.6 is sleeved in an inner hole of the lower sleeve 8.4, and is fixedly connected to the lower sleeve. An upper ribbed plate is weldedly connected to a lower end surface of the upper disc 8.5, and a lower ribbed plate 8.3 is weldedly arranged between the lower sleeve 8.4 and an upper end surface of the lower disc 8.1.

A first sliding bearing 15 is arranged at one end of an interior of the lower sleeve 8.4, and a second sliding bearing 16 is arranged at the other end of the interior of the lower sleeve 8.4. The first sliding bearing 15 and the second sliding bearing 16 are sleeved on the lower shaft 9.3.4 and the middle shaft 9.2 respectively. A positioning ring 18 is fixedly arranged on a side of the middle shaft 9.2 through positioning ring screws 10 and pushes the second sliding bearing 16 downward. Relatively, the lower frame 9.3 pushes the first sliding bearing 15 upward. In such cases, the first sliding bearing 15 and the second sliding bearing 16 together enable the entire drill pipe rack 8 to rotate merely on the frame 9. During rotation, the clamping assembly 6 always clamps the sampling drill pipe 7. Each drill pipe hole of the drill pipe rack 8 is provided with a sampling drill pipe 7, and a drive pipe 13 is screwedly connected to the sampling drill pipe 7 provided directly below the drive pipe 13.

The lower frame 9.3 includes two side plates 9.3.1, a reinforcement plate 9.3.2, a main plate 9.3.3 and a lower shaft 9.3.4. An end of lower shaft 9.3.4 is perpendicularly fixed to the main plate 9.3.3. A through inner hole is provided on the lower frame 9.3 at an axis of the lower shaft. The two side plates 9.3.1 are perpendicularly welded on two sides below the main plate 9.3.3, respectively. A lower part of each side plate 9.3.1 is provided with a rack mounting hole at the position near the axis of the lower shaft. The reinforcement plate 9.3.2 is perpendicularly welded between the two side plates 9.3.1, and is welded to a bottom of the main plate 9.3.3. The first sliding bearing 15 is provided between the drill pipe rack 8 and the lower frame 9.3. A lower portion of the first sliding bearing 15 is located between a lower end surface of the drill pipe rack 8 and the main plate 9.3.3, and an upper portion of the first sliding bearing 15 is located between the lower shaft 9.3.4 and an inner hole of the drill pipe rack 8.

The clamping assembly 6 includes a fixed clamping block 6.1, a movable clamping block 6.2, a pipe-pipe-clamping cylinder 6.3, a pre-tensioning spring 6.4, a loose piece 6.5, a screw 6.6, a bolt 6.7 and a gasket 6.8. The fixed clamping block 6.1 is fixedly arranged at the first drill pipe hole of the upper surface of the upper disc 8.5 of the drill pipe rack. A first semi-circular groove is provided on the side of the fixed clamping block 6.1 towards the center of a corresponding first drill pipe hole of the plurality of first drill pipe holes. The first semi-circular groove is coaxial with the corresponding first drill pipe hole. The gasket 6.8 is fixedly arranged on the first semi-circular groove, and an inner diameter of the gasket 6.8 is equal to an outer diameter of the sampling drill pipe 13. A second semi-circular groove is provided on the end surface towards the fixed clamping block, and an inner diameter of the second semi-circular groove is also equal to the outer diameter of the sampling drill pipe 13. The movable clamping block 6.1 is provided with two parallel bolt holes. The movable clamping block 6.1 is sleeved on two bolts 6.7 through the two bolt holes. The pipe-clamping cylinder 6.3 is provided with one bolt hole on each side, and is sleeved on the two bolts 6.7. Each bolt 6.7 is sleeved with a pre-tensioning spring 6.4, and the pre-tensioning spring 6.4 is located between the pipe-clamping cylinder 6.3 and the movable clamping block 6.2. A piston rod of the pipe-clamping cylinder 6.3 abuts against the movable clamping block 6.1. The chamber of the pipe-clamping cylinder 6.3 near the movable clamping block 6.2 is communicated with outside and is capable of being filled with sea water. The piston rod of the pipe-clamping cylinder 6.3 is able to tighten the movable clamping block 6.2 outward, so that the gasket 6.8 is coaxial with the second semicircular groove, and thus securely clamping the sampling drill pipe 7. The loose piece 6.5 consists of a side plate and a bottom plate perpendicular to each other, where the bottom plate is fixed on a top surface of the movable clamping block. The side plate is provided with a screw 6.6. An axis of the screw 6.6 is perpendicular to the axis of the sampling drill pipe 7. A pipe-releasing assembly 11 is provided in correspondence with each clamping assembly 6.

The pipe-releasing assembly 11 includes two pipe-releasing electromagnets 11.1 and a pipe-releasing plate 11.2. The two pipe-releasing electromagnets 11.1 are respectively fixed on two sides of the second drill pipe hole on the bottom surface of the upper frame. Two ends of the pipe-releasing plate 11.2 are fixed to the movable ends of the two pipe-releasing electromagnets 11.1, respectively. The pipe-releasing plate 11.2 is in contact with the end of the screw 6.6 away from the pipe-clamping cylinder 6.3. The screw 6.6 is able to tighten and adjust the distance the pipe-releasing plate 11.2 from its end, so that when the drill pipe rack 8 is smoothly rotated, the pipe-releasing plate 11.2 can be driven by the two pipe-releasing electromagnets 11.1 to move the underneath movable clamping block 6.2 away from the sampling drill pipe 7, thus enabling the sampling drill pipe 7 to perform drilling and sampling along with the drive pipe 13.

Figure 5:
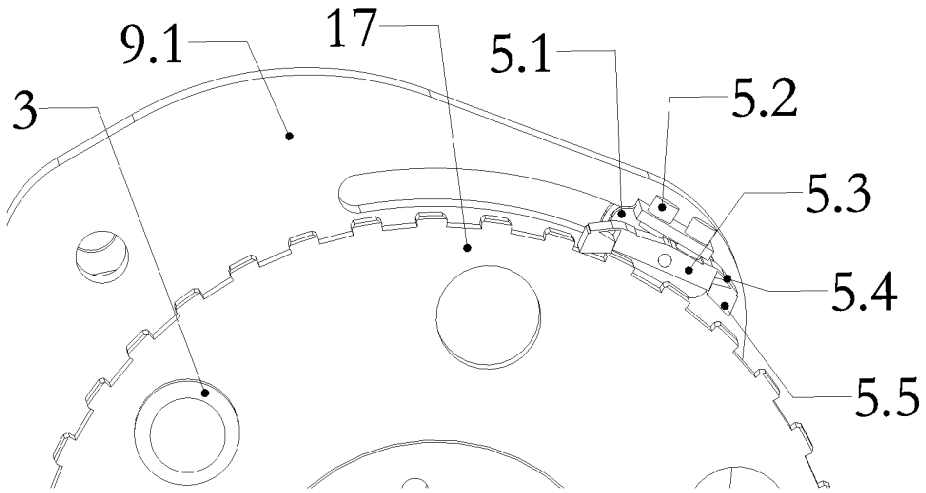
FIG. 5 is a structural diagram of a pipe-replacing disc of the drilling and sampling device according to an embodiment of the present disclosure.

As shown in FIGS. 1 and 5, the dial claw 5 includes a slide frame 5.1, an electromagnetic head 5.2, a seesaw 5.3, a spring sheet 5.4, and a claw head 5.5. An upper portion of the slide frame 5.1 is hingedly connected to an end of the pipe-replacing cylinder 4, and the other end of the pipe-replacing cylinder 4 is hingedly connected to the upper frame 9.1. A middle portion of the slide frame 5.1 is mounted in the arc guide groove of the upper frame, and a lower portion of the slide frame is hingedly connected to a middle portion of the seesaw, where a hinged axis is parallel to an axis of the arc guide groove. The pipe-replacing cylinder 4 can drive the slide frame 5.1 to slide in the arc guide groove of the upper frame 9.1. Each of two ends of the seesaw 5.3 is fixedly provided with a spring sheet 5.4. One end of each spring sheet is fixedly provided with a claw head 5.5. A rectangular groove is provided on a side of the pipe-replacing disc 17, which can be engaged with the claw head 5.5. The surface of the claw head 5.5 towards the side of the pipe-replacing disc 17 is inclined, so that when the claw head 5.5 is jammed into the rectangular groove on the pipe-replacing disc 17, the functions of a ratchet wheel mechanism can be realized. An electromagnetic head is provided near each of the outer ends of the seesaw 5.3, which can control any one of the claw head 5.5 on the seesaw 5.3 to snap into the rectangular groove on the pipe-replacing disc 17. When the dial claw 5 moves the pipe-replacing disc 17 to drive anyone of the sampling drill pipes 7 to coincide with the axis of the drive pipe 13, an output end of the positioning electromagnet 3 on the upper frame 9.1 can extend into the positioning hole in the pipe-replacing disc 17, such that the position of the sampling drill pipe 7 can be accurately restricted. The movable end of the positioning electromagnet 3 passes through the upper frame 9.1 and then is coaxially inserted into the positioning hole in the pipe-replacing disc, where the diameter of the movable end is equal to that of the positioning hole.

The drilling and sampling operations of the drilling and sampling device provided herein are described below. The drive pipe 13 points at the target area for drilling and sampling, then the position of a target sampling drill pipe 7 relative to the drive pipe 13 is determined. The working state of the dial claw 5 is confirmed to determine which electromagnetic head 5.2 needs to be supplied with power. Subsequently, the pipe-replacing cylinder 4 is activated. When the target sampling drill pipe 7 is substantially coaxial with the drive pipe 13, the positioning electromagnet 3 is activated to precisely position the target sampling drill pipe 7. The clamp assembly 6 corresponding to target sampling drill pipe 7 is clamped tightly, and then the two thrust cylinders 2 and the power heads are synchronously activated, so that the drive pipe 13 and the target sampling drill pipe 7 are firmly screwed together. Finally, by activating the two electromagnets 11.1 and releasing the clamping assembly 6 at the target sampling drill pipe 7, the target sampling drill pipe 7 can be released for drilling and sampling actions. After completing the sampling, the sampling drill pipe 7 is withdrawn to the original position, the clamping assembly 6 is clamped again, and then the power heads 14 and the two thrust cylinder 2 are activated, so as to complete the unbuckling of the sampling drill pipe 7 from the drive pipe 13. After that, it is possible to search for the next sampling target point, and the previous operations are repeated to realize the drilling and sampling at multiple points.

What is claimed is:

1. A drilling and sampling device applied to a seafloor tracked vehicle, comprising:

a slide seat;

a positioning electromagnet;

a pipe-replacing cylinder;

a dial claw;

a plurality of clamping assemblies;

a plurality of sampling drill pipes;

a drill pipe rack;

a frame;

two thrust cylinders;

a pipe-releasing assembly;

a guide rod;

a drive pipe;

a power head; and a pipe-replacing disc;

wherein the frame comprises a lower frame, a middle shaft and an upper frame from bottom to up; the upper frame is arranged on the lower frame through the middle shaft; the middle shaft is arranged perpendicular to the lower frame and the upper frame; the drill pipe rack is arranged outside the middle shaft and is coaxial with the middle shaft, and is capable of rotating around the middle shaft; the drill pipe rack is provided with a plurality of first drill pipe holes; the plurality of sampling drill pipes are provided in the plurality of first drill pipe holes in one-to-one correspondence; an axis of each of the plurality of the sampling drill pipes is parallel to an axis of the middle shaft; the plurality of sampling drill pipes are evenly arranged around a circumferential direction of the drill pipe rack; the plurality of clamping assemblies are arranged at the plurality of first drill pipe holes in one-to-one correspondence; the plurality of clamping assemblies are configured to respectively clamp the plurality of sampling drill pipes; and the pipe-replacing disc is coaxially and fixedly arranged on a top of the drill pipe rack;

the guide rod and the two thrust cylinders are fixedly arranged on the frame; axes of the guide rod and the two thrust cylinders are parallel to the axis of each of the plurality of sampling drill pipes; the slide seat is provided with a guide hole; the slide seat is in clearance fit with the guide rod; a piston rod end of one of the two thrust cylinders is hingedly connected to a first end of the slide seat, and a piston rod end of the other of the two thrust cylinders is hingedly connected to a second end of the slide seat; the power head is fixedly arranged on the slide seat; the drive pipe is arranged at an output end of the power head; the drive pipe is configured to be coaxially and screwedly connected with each of the plurality of sampling drill pipes through a second drill pipe hole on the upper frame; and the pipe-releasing assembly is arranged at a position on a bottom surface of the upper frame where the second drill pipe hole is located; the upper frame is provided with an arc guide groove coaxial with the drill pipe rack; the dial claw is slidably arranged in the arc guide groove; a lower portion of the dial claw is engaged with rectangular teeth on an edge of the pipe-replacing disc; an upper portion of the dial claw is hingedly connected to a first end of the pipe-replacing cylinder, and a second end of the pipe-replacing cylinder is hingedly connected to the upper frame; the positioning electromagnet is arranged on the upper frame; a moving end of the positioning electromagnet is configured to pass through the upper frame to be coaxially inserted into a positioning hole of the pipe-replacing disc; and a diameter of the moving end is equal to that of the positioning hole of the pipe-replacing disc.

2. The drilling and sampling device of claim 1, wherein each of the plurality of clamping assemblies comprises a fixed clamping block, a gasket, a movable clamping block, two bolts, a pre-tensioning spring, and a pipe-clamping cylinder; the fixed clamping block is fixedly arranged on the drill pipe rack; the two bolts are provided on the fixed clamping block and parallel to each other; a first semi-circular groove is provided on an end surface of the fixed clamping block towards a center of a corresponding first drill pipe hole of the plurality of first drill pipe holes; the gasket is fixedly arranged in the first semi-circular groove; the first semi-circular groove is coaxial with the corresponding first drill pipe hole; the movable clamping block is provided with two first bolt holes parallel to each other, and is sleeved on the two bolts through the two first bolt holes; a second semi-circular groove is provided on an end surface of the movable clamping block towards the fixed clamping block; two sides of the pipe-clamping cylinder each are provided with a second bolt hole; the pipe-clamping cylinder is sleeved on the two bolts; each of the two bolts is sleevedly provided with the pre-tensioning spring; the pre-tensioning spring is located between the pipe-clamping cylinder and the movable clamping block; a piston rod of the pipe-clamping cylinder abuts against the movable clamping block; a chamber of the pipe-clamping cylinder near the movable clamping block is communicated with outside and is capable of being filled with sea water.

3. The drilling and sampling device of claim 2, wherein each of the plurality of clamping assemblies further comprises a loose piece; the number of the pipe-releasing assembly is two or more; the loose piece consists of a side plate and a bottom plate perpendicular to the side plate; the bottom plate is fixed on a top surface of the movable clamping block; the side plate is provided with a screw; an axis of the screw is perpendicular to the axis of each of the plurality of sampling drill pipes; the two or more pipe-releasing assemblies are in one-to-one correspondence to the plurality of clamping assemblies; each of the two or more pipe-releasing assemblies comprises two pipe-releasing electromagnets and a pipe-releasing plate; the two pipe-releasing electromagnets are respectively fixed on two sides of the second drill pipe hole on the bottom surface of the upper frame; two ends of the pipe-releasing plate are fixed to movable ends of the two pipe-releasing electromagnets, respectively; and the pipe-releasing plate is in contact with an end of the screw away from the pipe-clamping cylinder.

4. The drilling and sampling device of claim 1, wherein the drill pipe rack comprises a lower disc, a lower sleeve, an upper disc, an upper sleeve, and a bushing; the lower disc is coaxial with the upper disc; a plurality of first through holes are uniformly provided on the lower disc around a circumferential direction of the lower disc, and a plurality of second through holes are uniformly provided on the upper disc around a circumferential direction of the upper disc; the plurality of first through holes are in one-to-one correspondence with the plurality of second through holes; and one of the plurality of first through holes and one of the plurality of second through holes corresponding thereto are coaxial to form one of the plurality of first drill pipe holes; and the bushing is fixedly arranged in each of the plurality of first through holes, and an inner diameter of the bushing is larger than an outer diameter of each of the plurality sampling drill pipes; the upper sleeve is weldedly arranged in a center hole of the upper disc, and the lower sleeve is weldedly arranged in a center hole of the lower disc; the upper sleeve is sleeved in an inner hole of the lower sleeve, and is fixedly connected to the lower sleeve; and an upper ribbed plate is weldedly connected to a lower end surface of the upper disc, and a lower ribbed plate is weldedly arranged between the lower sleeve and an upper end surface of the lower disc.

5. The drilling and sampling device of claim 1, wherein the lower frame comprises two side plates, a reinforcement plate, a main plate and a lower shaft; an end of the lower shaft is perpendicularly fixed to the main plate; a through inner hole is provided on the lower frame at an axis of the lower shaft; the two side plates are perpendicularly welded on two sides below the main plate, respectively; a lower part of each of the two side plates is provided with a rack mounting hole at a position near the axis of the lower shaft; the reinforcement plate is perpendicularly welded between the two side plates, and is welded to a bottom of the main plate; a first sliding bearing is provided between the drill pipe rack and the lower frame; and a lower portion of the first sliding bearing is located between a lower end surface of the drill pipe rack and the main plate, and an upper portion of the first sliding bearing is located between the lower shaft and an inner hole of the drill pipe rack.

6. The drilling and sampling device of claim 5, wherein a lower end surface of the middle shaft is coaxially welded to an upper end surface of the lower shaft; a second sliding bearing is provided between the middle shaft and the drill pipe rack; a lower portion of the second sliding bearing is located between the middle shaft and the drill pipe rack, and an upper portion of the second sliding bearing is located between a positioning ring on the middle shaft and a lower sleeve of the drill pipe rack; and an upper end surface of the second sliding bearing is located below a lower end surface of an upper sleeve of the plurality of sampling drill pipes.

7. The drilling and sampling device of claim 1, wherein the dial claw comprises a slide frame, a seesaw, a claw head, a spring sheet and an electromagnetic head; an upper portion of the slide frame is hingedly connected to an end of the pipe-replacing cylinder; a middle portion of the slide frame is mounted in the arc guide groove of the upper frame; a lower portion of the slide frame is hingedly connected to a middle portion of the seesaw, wherein a hinged axis is parallel to an axis of the arc guide groove; the electromagnetic head is fixedly provided near each of two outer ends of the seesaw; each of two ends of the seesaw is fixedly provided with the spring sheet; the spring sheet is provided with the claw head; a side of the claw head near an end of the seesaw abuts against the end of the seesaw; a side of the claw head towards a side of the pipe-replacing disc is inclined; and the electromagnetic head is capable of controlling the claw head to be clamped into a rectangular groove on the pipe-replacing disc.

* * * * *